US010304299B1

(12) United States Patent
Acosta et al.

(10) Patent No.: US 10,304,299 B1
(45) Date of Patent: May 28, 2019

(54) CONTAINER BREACH DETECTOR

(71) Applicant: Container Seal Project Partners, LLC, Stuart, FL (US)

(72) Inventors: Enrique Acosta, Stuart, FL (US); Michael Ray Wilkinson, Richardson, TX (US); Harley Michael Willey, Garland, TX (US); Preston Taylor Thorpe, Dallas, TX (US); Lyndl Brent Duncan, McKiney, TX (US); Gustavo Gerardo Suarez, San Jose, CA (US); Warren Katzman, Monsey, NY (US)

(73) Assignee: E-S Information Systems Inc., Stuart, FL (US)

( * ) Notice: Subject to any disclaimer, the term of this patent is extended or adjusted under 35 U.S.C. 154(b) by 0 days.

(21) Appl. No.: 15/877,511

(22) Filed: Jan. 23, 2018

(51) Int. Cl.

| | |
|---|---|
| ***G08B 13/08*** | (2006.01) |
| ***G08B 13/02*** | (2006.01) |
| ***G08B 13/19*** | (2006.01) |
| ***G08B 13/189*** | (2006.01) |

(52) U.S. Cl.
CPC ..... *G08B 13/08* (2013.01); *G08B 13/02* (2013.01); *G08B 13/1895* (2013.01); *G08B 13/19* (2013.01)

(58) Field of Classification Search
CPC .... G08B 13/08; G08B 13/02; G08B 13/1895; G08B 13/19
USPC ..... 340/545.6
See application file for complete search history.

(56) References Cited

U.S. PATENT DOCUMENTS

| | | | | |
|---|---|---|---|---|
| 4,793,500 | A | 12/1988 | Harding | |
| 5,524,294 | A | 6/1996 | Richardson et al. | |
| 5,882,116 | A | 3/1999 | Backus | |
| 6,095,355 | A | 8/2000 | Jessen et al. | |
| 6,179,139 | B1 | 1/2001 | Heilman | |
| 6,806,807 | B2 | 10/2004 | Cayne et al. | |
| 6,877,631 | B1 | 4/2005 | Thompson et al. | |
| 7,315,246 | B2 * | 1/2008 | Rajapakse | B65D 90/22 340/545.1 |
| 7,436,298 | B2 | 10/2008 | Rajapakse et al. | |
| 7,456,738 | B2 | 11/2008 | Yoong | |
| 7,586,409 | B2 | 9/2009 | Armstrong et al. | |
| 8,022,573 | B2 * | 9/2011 | Powers | E05B 39/005 307/64 |
| 8,666,664 | B2 | 3/2014 | Chiu et al. | |
| 9,460,593 | B2 | 10/2016 | Acosta et al. | |
| 9,483,724 | B2 | 11/2016 | Coveley et al. | |

(Continued)

*Primary Examiner* — Jack K Wang
(74) *Attorney, Agent, or Firm* — Albert Bordas, P.A.

(57) ABSTRACT

A container breach detector system, which has a self-contained container breach detector having a housing with a mounting plate. At least one retaining clip retains a collapsible detector device. The self-contained container breach detector is mounted onto a door frame of a transportation container to monitor breaches of the transportation container, whereby the collapsible detector device is in a collapsed configuration when the door is closed, and in a neutral configuration when the door is opened. The self-contained container breach detector further has an electrical system having at least one set of sensors having at least one IR proximity and distance sensor that detects a proximity or distance change of the door internal face when the collapsible detector device changes from the collapsed configuration to the neutral configuration indicating that the door is open.

28 Claims, 12 Drawing Sheets

(56) References Cited

U.S. PATENT DOCUMENTS

| | | | | |
|---|---|---|---|---|
| 2008/0252450 | A1* | 10/2008 | Wandel | B65D 55/026 340/541 |
| 2010/0163731 | A1 | 7/2010 | Terence et al. | |
| 2012/0112910 | A1* | 5/2012 | Meyers | G08B 13/08 340/547 |

* cited by examiner

CONTAINER BREACH DETECTOR

BACKGROUND OF THE INVENTION

1. Field of the Invention

The present invention relates to security systems, and more particularly, to breach detector systems for transportation containers.

2. Description of the Related Art

Applicant believes that one of the closest references corresponds to Applicant's own U.S. Pat. No. 9,460,593 issued to Enrique Acosta, et al. on Oct. 4, 2016 for Container breach detector system. However, it differs from the present invention because Acosta, et al. teaches a container breach detector system to monitor breaches of a transportation container. A self-contained container breach detector provides activation, status, and/or breach event date and time stamp data and a unique identification number of a communication tower, for a user to determine when and where authorized and/or unauthorized breaches of the transportation container occurred. Furthermore, the self-contained container breach detector serves as a recording device to record the activation, status, and/or breach event date and time stamp data; and communicates via various communication means including text via short message service, SMS, and/or e-mail. A container breach detector is intended for a one-time use only, to be discarded at destination. Each container breach detector has individual serial numbers. An encapsulating composition ensures that the self-contained container breach detector is used only once, and is not removed, recharged and reused, whereby removal of the encapsulating composition would damage its electrical system.

Applicant believes that another reference corresponds to U.S. Pat. No. 4,793,500 issued to Claude J. Harding on Dec. 27, 1988 for Tamper indicator. However, it differs from the present invention because Harding teaches a tamper indicator which includes a first indicator element coupled to a first cylindrical element, a second indicator element positioned within a second cylindrical element and displaceable between a first position spaced apart from the first indicator element and a second position contacting the first indicator element. The first indicator element changes visual states when it contacts the second indicator element. A biasing device biases the first indicator element toward the second indicator element. A locking system maintains the first and second indicator elements in a locked, spaced apart configuration while the first and second cylindrical elements remain in a first location. The locking device enables relative movement to occur between the first and second indicator elements after the first and second cylindrical elements have been displaced from the first position into a second position. The locking device enables the biasing device to displace the first and second indicator elements together to establish contact and to effect the change in visual state of the first indicator element upon displacement of the first and second cylindrical elements from the second position into a third position.

Applicant believes that another reference corresponds to U.S. Pat. No. 5,524,294 issued to Richardson, et al. on Jun. 11, 1996 for Tamper or damage indicating members. However, it differs from the present invention because Richardson, et al. teach an apparatus for providing a tamper or damage indicating member, such as a tamper evident glove.

The apparatus comprises first and second layers, typically inner and outer glove shaped bodies, of substantially liquid and air impermeable material, at least a portion of the second layer being of translucent material and having a contrasting color relative to the first layer. The apparatus further comprises means for sealing at least the portion of the second layer to the first layer, such that the portion surrounds a zone of the surface of the first layer, forming a space between the layers, which is adjacent the zone and is substantially free of air. When the second layer is sealed to the first layer, breach in either layer adjacent the zone results in a change in perceived color in the area of breach.

Applicant believes that another reference corresponds to U.S. Pat. No. 5,882,116 issued to Alan Backus on Mar. 16, 1999 for Tamper indication device. However, it differs from the present invention because Backus teaches Sheets used to indicate when tampering has occurred. Such sheets are composed of envelopes with generally thin cross sections containing compressed resilient cores, which expand upon envelope breach. Expansion of the resilient core results in an obvious visual change to all or some of the envelope surfaces. Such envelopes may also contain a translucent liquid, which greatly aids in amplifying the visual changes such envelopes may exhibit. Embodiments may take the form of applied labels, adhesive tape, wrapping paper, mail envelopes, bottle caps, document enclosures, blister packs, etc.

Applicant believes that another reference corresponds to U.S. Pat. No. 6,095,355 issued to Jessen, et al. on Aug. 1, 2000 for Tamper evident seal for connector type container orifices. However, it differs from the present invention because Jessen, et al. teach a tamper evident seal for container orifices of the connector type, comprising a closure part. The closure part has an annular section on its bottom side, whose lower rim area is sealably retained in an annular gap formed in the opening area of the orifice.

Applicant believes that another reference corresponds to U.S. Pat. No. 6,179,139 issued to Robert John Heilman on Jan. 30, 2001 for Tamper indicating closure. However, it differs from the present invention because Heilman teaches a button type closure with a tamper-indicating element that visually indicates when a container has been opened. A deflectable button on an actuator panel is utilized to fracture a disk of brittle material situated between the button and a rigid transparent plastic holder into which the actuator panel and brittle disk are inserted. The plastic holder not only carries the actuator panel and brittle disk, but it also has provisions to hold the deflectable button in its down position by pressing the down button tightly against a rib on the underside of the holder, thus holding the deflectable button in the down position before the closure is applied to a container. When the closure is applied to a container the container finish deforms a region on the actuator panel adjacent to the button, decreasing the overall height of the actuator panel, so that after application of the closure to a container, only the container finish is pressing the down button tightly against the rib on the underside of the holder, thus continuing to prevent the button from popping up. Upon opening the package, the separation of the actuator panel and container finish permits the deformed actuator panel and the transparent holder to separate also, releasing the down button, allowing it to flip back to its up position, striking the brittle disk and fracturing it, thus producing an irreversible indication that the package has been opened.

Applicant believes that another reference corresponds to U.S. Pat. No. 6,806,807 issued to Cayne, et al. on Oct. 19, 2004 for Intelligent locking system. However, it differs from the present invention because Cayne, et al. teach an electronic locking system with a plurality of lockable storage enclosures, and a controller for controlling locking and unlocking of the storage enclosures. The system also includes a biometric sensor in communication with the controller for sensing one or more identifying characteristics of users, the controller being adapted to store the one or more identifying characteristics from the users in a memory and linking the stored identifying characteristics for the users with one of the lockable storage enclosures. The system is dynamic so that each time a lockable storage enclosure is used, one or more new identifying characteristics are associated with the lockable storage enclosure for locking and unlocking the lockable storage enclosure, and an intelligent locking device having a first slidable bolt for locking and unlocking a first enclosed area and a second slidable bolt for locking and unlocking a second enclosed area.

Applicant believes that another reference corresponds to U.S. Pat. No. 6,877,631 issued to Thompson, et al. on Apr. 12, 2005 for Tamper evident container. However, it differs from the present invention because Thompson, et al. teach a tamper evident container which has a body portion, a lid portion adapted to engage and close the body portion, and at least one tamper evident element releasably attached to one of the portions by a weakened connection, and having an operative position cooperating with means on the other of said portions to prevent removal of the lid portion from the body portion, the lid portion only being removable from the body portion subsequent to breakage of the weakened connection between the or each tamper evident element and the one portion of the container, the or each tamper evident element, on breakage, having a displaced position on the other portion of the container providing a visual indication that tampering may have occurred, and the container incorporating means to retain the or each tamper evident element in its displaced position on the other portion of the container such that removal of the or each tamper evident element from its displaced position cannot be effected without damage to the element.

Applicant believes that another reference corresponds to U.S. Pat. No. 7,436,298 issued to Rajapakse, et al. on Oct. 14, 2008 for Container security and monitoring. However, it differs from the present invention because Rajapakse, et al. teach a device having a support that can resiliently and removably grip an edge portion of a member with first and second portions thereof disposed on opposite sides of the member. A further portion on the first portion can operatively couple sensing structure to an electrical conductor portion on the third portion. A different embodiment has a support that can resiliently and removably grips an edge portion of a member with first and second portions thereof disposed on opposite sides of the member. A further portion on the support has circuitry coupled to a wireless communication portion on the first portion. Another embodiment has a support with structure supported thereon, the support resiliently and removably gripping the edge portion of a movable door with first and second portions of the support disposed on opposite sides of the edge portion.

Applicant believes that another reference corresponds to U.S. Pat. No. 7,456,738 issued to Koon-Chong Hammond Yoong on Nov. 25, 2008 for Transport refrigeration door status sensing device. However, it differs from the present invention because Yoong teaches a door status sensing device for a transport container including a door. The door status sensing device includes an emitter attached to the container that transmits a first wireless signal in a first direction toward the door. A reflector attaches to the door and is aligned with the emitter to receive the first wireless signal, and generates a second wireless signal in a second direction opposite the first direction in response to the first wireless signal. The sensing device further includes a receiver attached to the container adjacent the emitter and opposite the reflector. The receiver is substantially aligned with the reflector, receives the second wireless signal, and generates a third signal indicative of the condition of the door condition in response to receipt of the second wireless signal. A controller selectively generates an alarm in response to the third signal indicative of the condition of the door.

Applicant believes that another reference corresponds to U.S. Pat. No. 7,586,409 issued to Armstrong, et al. on Sep. 8, 2009 for Container monitoring system. However, it differs from the present invention because Armstrong, et al. teach a container monitoring system which includes a microprocessor comprising a memory to store data, and a control program executed by said the microprocessor, the microprocessor having a stand-by mode and an active mode, a communications means connected to the microprocessor for transmitting data from the microprocessor to a monitoring station, a zone monitoring device on the container connected to the microprocessor in a loop with the microprocessor in the stand-by mode, a power source for supplying power to the microprocessor, communications means and zone monitoring device, wherein upon said microprocessor receiving an input signal from the zone monitoring device, the control program directs the microprocessor to switch to active mode, generate and store in the memory an alarm message corresponding to the input signal from the zone monitoring device, activate the communications means, and transmit the alarm message to a monitoring station.

Applicant believes that another reference corresponds to U.S. Pat. No. 8,666,664 issued to Chiu, et al. on Mar. 4, 2014 for Electronic seal. However, it differs from the present invention because Chiu, et al. teach an electronic seal, which includes a bolt. The bolt is used to mount on a door latch of a cargo and inserts into a shell. The shell is provided with a control circuit to actively send a warning signal as the bolt is moved. As such, the user of the electronic seal can be properly informed to prevent theft.

Applicant believes that another reference corresponds to U.S. Pat. No. 9,483,724 issued to Coveley, et al. on Nov. 1, 2016 for Passive tamper resistant seal and applications therefor. However, it differs from the present invention because Coveley, et al. teach a ribbon which has a substrate, and a plurality of radio frequency identification (RFID) seals on the substrate. Different RFID seals detune in response to differing tensile loads.

Applicant believes that another reference corresponds to U.S. Patent Application Publication No. 2010/0163731, published on Jul. 1, 2010 to Terence, et al. for Enclosure door status detection. However, it differs from the present invention because Terence, et al. teach an enclosure door status which may be detected. Light may be transmitted from a first component. The light may be received at a second component when a door is in a substantially closed position. The door may be mounted on a structure wherein an angle of incidence between the light transmitted from the first component and the second component increases proportionally to an angle of incidence between the door and the structure. The door may be determined to be in an open position when a light intensity received at the second component is less than a predetermined light intensity value that corresponds to a predetermined angle of incidence between the door and the structure. The first component may have a low divergence light emitting diode (LED) transmitter that may be configured to transmit light at a wavelength of approximately 950 nm. The second component may have a low profile silicon photodiode.

Other patents describing the closest subject matter provide for a number of more or less complicated features that fail to solve the problem in an efficient and economical way. None of these patents suggest the novel features of the present invention.

SUMMARY OF THE INVENTION

The present invention is a container breach detector system, comprising a self-contained container breach detector having a housing. The housing comprises a mounting plate having a mounting wall, which defines at least one sensor cavity. Secured onto the mounting wall is at least one retaining clip that retains a collapsible detector device. The collapsible detector device comprises a reflector that is at a first predetermined distance from the mounting wall when the collapsible detector device is in a neutral configuration, and is at a second predetermined distance from the mounting wall when the collapsible detector device is in a collapsed configuration.

The self-contained container breach detector is mounted onto a door frame of a transportation container. The transportation container has at least one door with a respective door internal face. The self-contained container breach detector is positioned whereby the mounting plate faces the door internal face and is entirely mounted within the transportation container to monitor breaches of the transportation container, whereby the collapsible detector device is in the collapsed configuration when the door is closed and the collapsible detector device is in the neutral configuration when the door is opened.

The self-contained container breach detector further comprises an electrical system, which has a main printed circuit board, a global system for mobile communications radio module circuitry having cellular network communication means with capabilities to communicate directly to and from a public cellular receiver tower positioned at a working range from the self-contained container breach detector, a power circuitry comprising power means, and at least one set of sensors wireless technology standard comprising at least one IR proximity and distance sensor, wireless technology standard, and subscriber identity module card circuitry, wherein the at least one IR proximity and distance sensor detects a proximity or distance change of the door internal face when the collapsible detector device changes from the collapsed configuration to the neutral configuration indicating that the door is open. The electrical system further comprises a central processing unit. The at least one IR proximity and distance sensor is mounted onto the at least one sensor cavity and is aligned with the reflector.

The mounting plate comprises at least one mounting hook to secure the at least one retaining clip. The at least one retaining clip comprises at least one plate hole that receives the at least one mounting hook to secure the at least one retaining clip. The at least one retaining clip comprises a retaining plate, an exterior face ring, and an interior face ring. The exterior face ring and the interior face ring comprise a notch. The at least one retaining clip further has retaining hooks to secure the retaining plate.

The collapsible detector device comprises a sidewall that extends between a top edge and a neck, and extending from the neck is a collapsible sidewall. The collapsible sidewall extends to a non-collapsible sidewall that has a first diameter. The non-collapsible sidewall has a base lip having a second diameter, wherein the second diameter of the base lip is larger than the first diameter of the non-collapsible sidewall. The base lip is positioned between the interior face ring and the mounting wall when the at least one retaining clip retains the collapsible detector device. A base protrusion extends from the base lip and the non-collapsible sidewall towards the collapsible sidewall but without reaching the collapsible sidewall. The interior face ring has a third diameter, wherein the second diameter and the third diameter are approximately the same size. The reflector is mounted internally onto an interior reflector wall within the collapsible detector device. The sidewall comprises a drain hole and the top edge comprises an exterior notch. The at least one set of sensors wireless technology standard comprises at least one ambient light sensor, at least one humidity sensor and/or at least one temperature sensor. The at least one set of sensors, wireless technology standard, and subscriber identity module card circuitry are mounted onto the main printed circuit board.

The housing comprises a wall defined between a top wall and a bottom wall, first and second lateral walls and a perimeter edge. Opposite the wall is the mounting plate, and the electrical system is embedded within the housing.

The self-contained container breach detector further comprises an encapsulating composition, which ensures that the self-contained container breach detector is used only once, whereby removal of the encapsulating composition damages the electrical system. The encapsulating composition is an optically clear epoxy chemical composition filling within the housing to cover the electrical system. The self-contained container breach is secured with at least one double-sided tape.

The self-contained container breach detector provides activation, status, and/or breach event date and time stamp data and a unique identification number of the public cellular receiver tower being a communication tower, to identify when and where authorized and/or unauthorized breaches of the transportation container occurred when the at least one IR proximity and distance sensor and/or the at least one ambient light sensor is activated.

The self-contained container breach detector serves as a recording device to record activation, status, and/or breach event date and time stamp data and a unique identification number of the public cellular receiver tower being a communication tower.

Recorded activation, status, and/or breach event date and time stamp data and the unique identification number of the communication tower, is communicated via the cellular network communication means including text via short message service, SMS, and/or internet protocol communications including TCP/IP, UDP/IP, and e-mail, to respective the communication tower.

Alternatively, recorded activation, status, and/or breach event date and time stamp data and the unique identification number of the communication tower, is communicated via the cellular network communication means including text via short message service, SMS, and/or internet protocol communications including TCP/IP, UDP/IP, and e-mail, to an operations center having at least one server(s) and/or computer(s).

Alternatively, recorded activation, status, and/or breach event date and time stamp data and the unique identification number of the communication tower, is communicated via the cellular network communication means including text via short message service, SMS, and/or internet protocol communications including TCP/IP, UDP/IP, and e-mail, via Internet to designated computers and/or cell phones.

Alternatively, recorded activation, status, and/or breach event date and time stamp data and the unique identification number of the communication tower, is communicated via the cellular network communication means to cell phones.

The container breach detector system further comprises an industrial, scientific and medical band radio circuitry comprising remote control means to function as a remote control to request activation, status, and/or breach event date and time stamp data and a unique identification number of the public cellular receiver tower being a communication tower, to identify when and where authorized and/or unauthorized breaches of the transportation container occurred. The remote control means comprises an ISM power switch and an ISM radio.

It is therefore one of the main objects of the present invention to provide a container breach detector system that is effective against tampering.

It is another object of this invention to provide a container breach detector system that comprises date and time stamp data, and communication tower locations, allowing for users to determine when and where a breach occurred.

It is another object of this invention to provide such a container breach detector system that is inexpensive to implement and monitor while retaining its effectiveness.

It is another object of this invention to provide a container breach detector system that is volumetrically efficient while in operation.

It is another object of this invention to provide a container breach detector system that is of a durable and reliable construction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
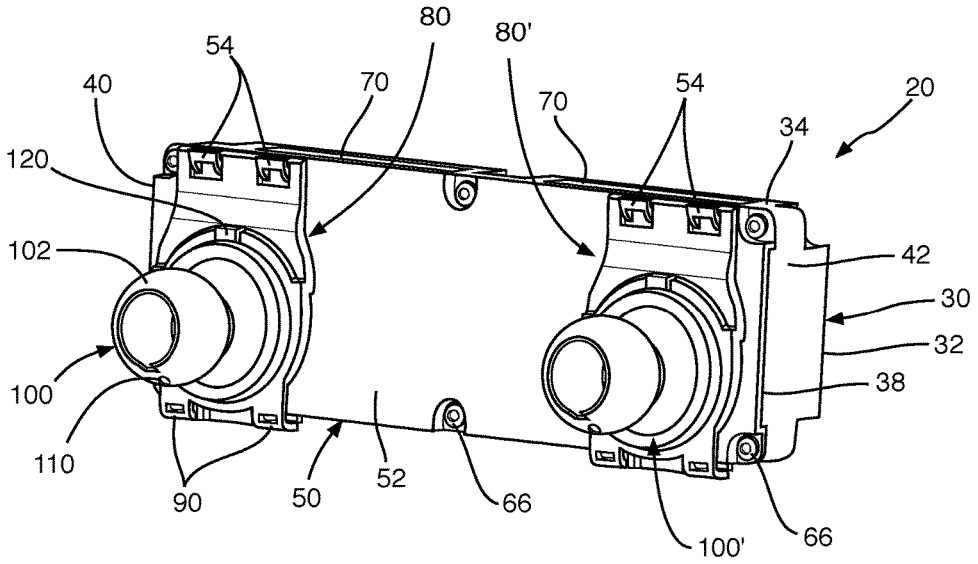
FIG. 1 is an isometric view of a self-contained container breach detector.

Referring now to the drawings, the present invention is a container breach detector system and is generally referred to with numeral 10. It can be observed that it basically includes self-contained container breach detector 20 mounted within transportation container 270.

Figure 2:
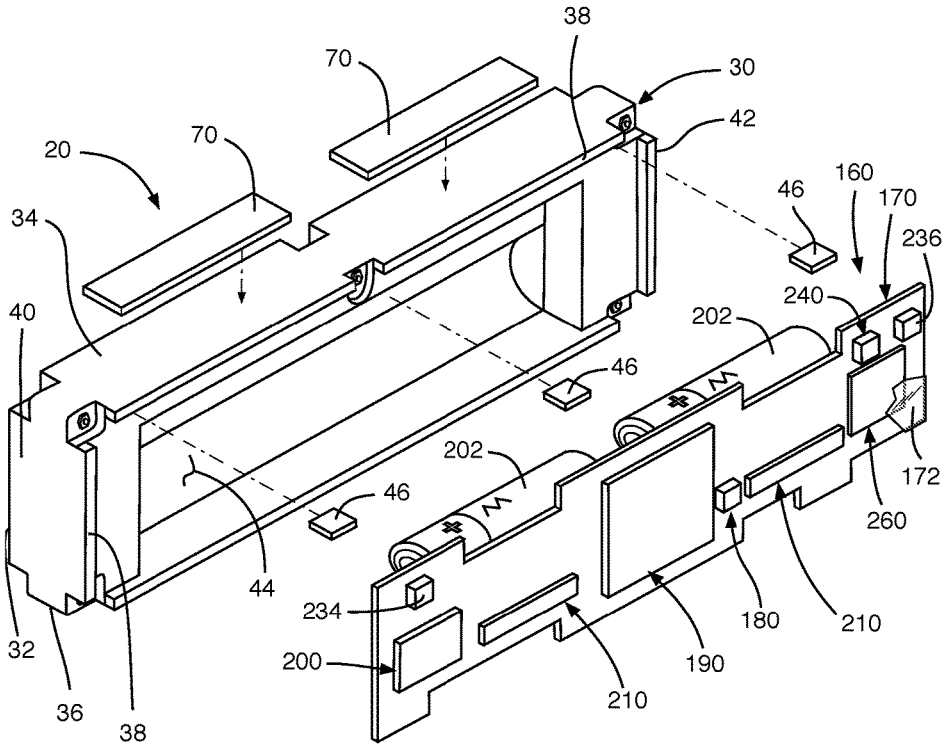
FIG. 2 is partial exploded view of an electrical system, housing, and magnets of the self-contained container breach detector.

As seen in FIGS. 1 and 2, self-contained container breach detector 20 comprises housing 30, mounting plate 50, retaining clip 80, and collapsible detector device 100. Mounting plate 50 has mounting wall 52. Secured onto mounting wall 52 is at least one retaining clip 80 that retains collapsible detector device 100. In a preferred embodiment, self-contained container breach detector 20 comprises first and second collapsible detector devices 100 and 100' retained by respective first and second retaining clips 80 and 80' onto mounting wall 52.

Housing 30 comprises wall 32 defined between top wall 34 and bottom wall 36. Housing 30 further comprises first and second lateral walls 40 and 42, and perimeter edge 38. Opposite wall 32 is mounting plate 50. An outside perimeter of perimeter edge 38 is approximately the same as an outside perimeter of mounting plate 50. Mounting plate 50 is secured onto housing 30 with screws 66. Housing 30 further comprises double-sided tape 70. In a preferred embodiment, double-sided tape 70 is positioned on top wall 34 to fix self-contained container breach detector 20 onto door frame 272 as seen in FIG. 3.

As seen in FIG. 2, self-contained container breach detector 20 further comprises electrical system 160, which is embedded within housing 30. Electrical system 160 comprises main printed circuit board 170. In a preferred embodiment, an inside perimeter of perimeter edge 38 is of a cooperative shape, and slightly larger than an outside perimeter of main printed circuit board 170, to receive it. Housing 30 further defines cavity 44 to receive components of electrical system 160 therein. Cavity 44 is of a cooperative shape to further receive at least one battery cell 202 and at least one magnet 46. In a preferred embodiment, there are two battery cells 202 positioned facing an interior face of wall 32, and three magnets 46 positioned on an interior face of top wall 34.

At least one set of sensors, wireless technology standard, and subscriber identity module (SIM) card circuitry 210 are mounted onto main printed circuit board 170 facing outwardly. At least one humidity sensor 234 and at least one temperature sensor 236 are positioned onto main printed circuit board 170. Self-contained container breach detector 20 further comprises encapsulating composition 172. Encapsulating composition 172 is an optically clear epoxy chemical composition filling within housing 30 to cover electrical system 160. Once main printed circuit board 170 is positioned into housing 30, a coating of encapsulating composition 172 is also placed onto an exterior side of main printed circuit board 170. Encapsulating composition 172 ensures that self-contained container breach detector 20 is used just once in a preferred embodiment, since removal of encapsulating composition 172 damages electrical system 160.

Figure 3:
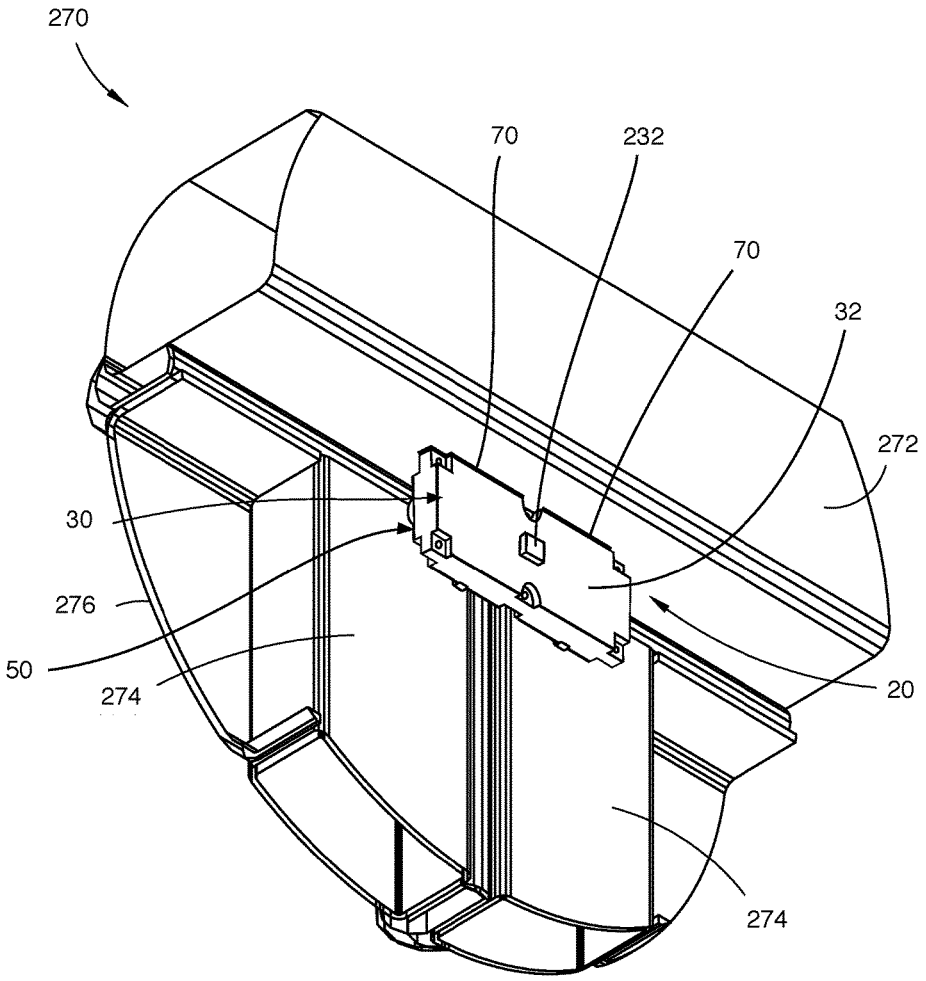
FIG. 3 is an isometric view of the self-contained container breach detector mounted internally within a transportation container.

As seen in FIG. 3, self-contained container breach detector 20 is mounted onto door frame 272 of transportation container 270. Transportation container 270 is also defined as a shipping container comprising at least one door. Transportation container 270 further comprises door internal face 274, and door external face 276. In a preferred embodiment, door frame 272 is made of a ferromagnetic material, such as steel or iron. The ferromagnetism is the basic mechanism by which certain materials form permanent magnets, or are attracted to magnets. Self-contained container breach detector 20 remains secured onto door frame 272 due to a predetermined magnetic force of at least one magnet 46, seen in FIG. 2, on door frame 272, and by double-sided tape 70. Self-contained container breach detector 20 is positioned onto transportation container 270, whereby mounting plate 50 faces door internal face 274. Self-contained container breach detector 20 is entirely mounted within transportation container 270 to monitor breaches of transportation container 270. At least one ambient light sensor 232 is positioned exteriorly onto wall 32. At least one ambient light sensor 232 is activated when light enters inside transportation container 270. Such light may enter into transportation container 270 if any door of transportation container 270 is opened, and/or if any opening is made to transportation container 270.

Figure 4:
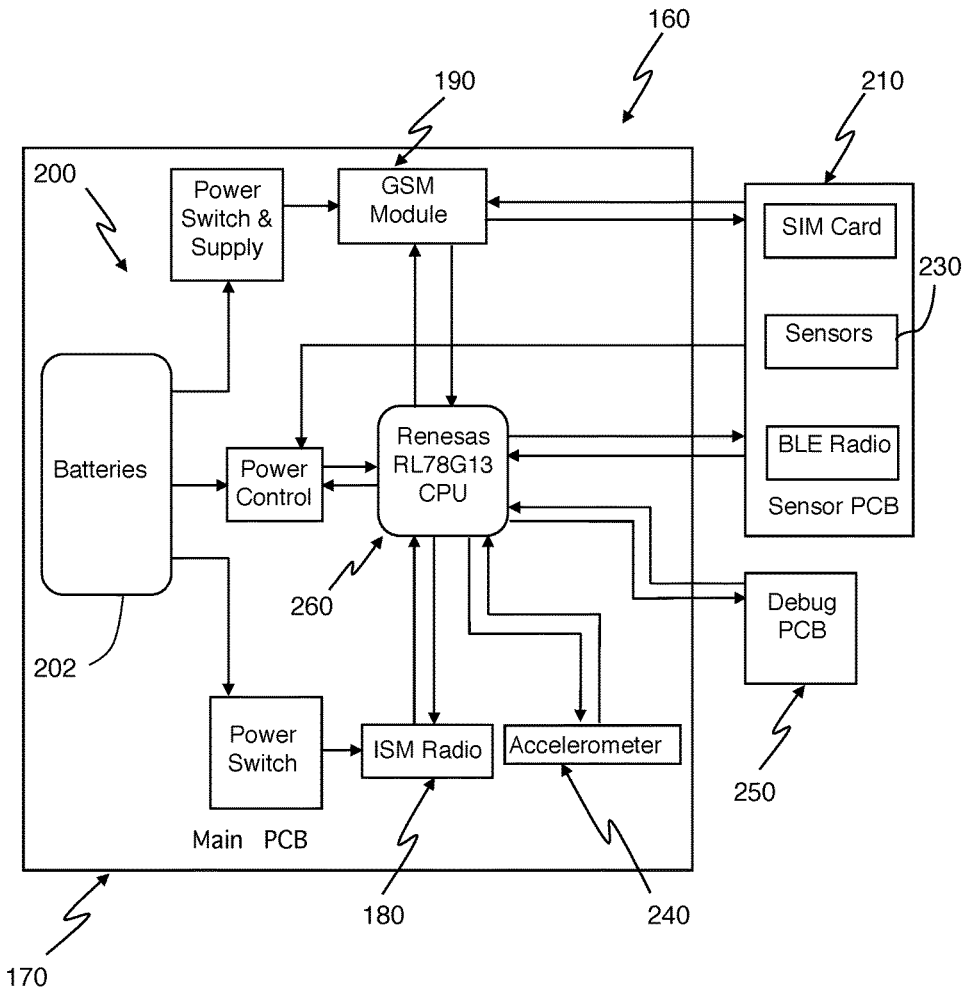
FIG. 4 is a system block diagram of the electrical system.

Seen in FIG. 4 is a system block diagram of electrical system 160, whereby electrical system 160 comprises main printed circuit board 170, ISM band radio circuitry 180, global system for mobile communications (GSM) radio module circuitry 190, power circuitry 200, sensors, wireless technology standard, and (SIM) card circuitry 210, accelerometer circuitry 240, debug printed circuit board 250, and central processing unit 260.

GSM radio module circuitry 190 comprises cellular network communication means with capabilities to communicate directly to and from a public cellular receiver tower positioned at a working range from self-contained container breach detector 20, seen in FIG. 1. GSM radio module circuitry 190 further comprises communication means to communicate data and/or to transmit activation, breach, and/or status event date and time stamp data via communication towers 300, seen in FIG. 15, to and from self-contained container breach detector 20. It is noted that GSM radio module circuitry 190 is a standard set to describe protocols for second-generation (2G) digital cellular networks used by smart and/or mobile phones. The GSM standard was developed as a replacement for first generation (1G) analog cellular networks, and originally described a digital, circuit switched network optimized for full duplex voice telephony. This was expanded over time to include data communications, first by circuit switched transport, then packet data transport via GPRS (General Packet Radio Services) and EDGE (Enhanced Data rates for GSM Evolution or EGPRS). However, GSM radio module circuitry 190 may also comprise (3G) UMTS standards, fourth generation (4G) LTE Advanced standards, and additional standards to enable communication of self-contained container breach detector 20 seen in FIG. 1.

Power circuitry 200 comprises power means, to power self-contained container breach detector 20 seen in FIG. 1. The power means comprises at least one battery cell 202. At least one battery cell 202 may be any cell battery including AA primary lithium cell types or D-cell type batteries. Power circuitry 200 has a phototransistor that turns power "on" for electrical system 160 when at least one set of sensors, wireless technology standard, and SIM card circuitry 210 is activated.

Figure 5:
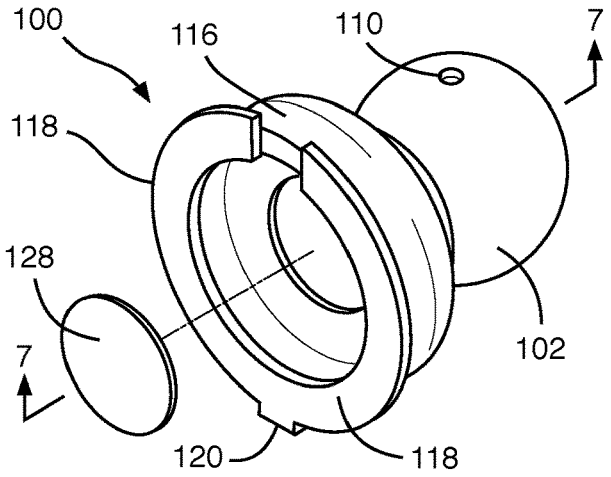
FIG. 5 is a first isometric view of a collapsible detector device.
Figure 6:
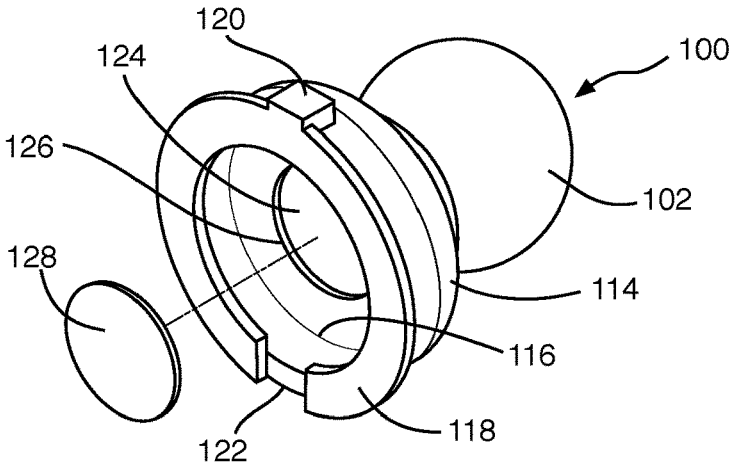
FIG. 6 is a second isometric view of the collapsible detector device.

As seen in FIGS. 5 and 6, collapsible detector device 100 comprises sidewall 102, collapsible sidewall 114 and non collapsible sidewall 116. Sidewall 102 is spherical in shape and has drain hole 110 for condensation and the like. Non collapsible sidewall 116 comprises base lip 118 having base protrusion 120, and base notch 122. In a preferred embodiment, base protrusion 120 and base notch 122 are opposite each other. Collapsible detector device 100 further comprises reflector 128.

Collapsible detector device 100 is made of elastic, moldable and resistant materials, which allow collapsible sidewall 114 to collapse when a predetermined force is applied over collapsible detector device 100. In a preferred embodiment, collapsible detector device 100 is made of rubber material and/or materials having rubber like characteristics.

Figure 7:
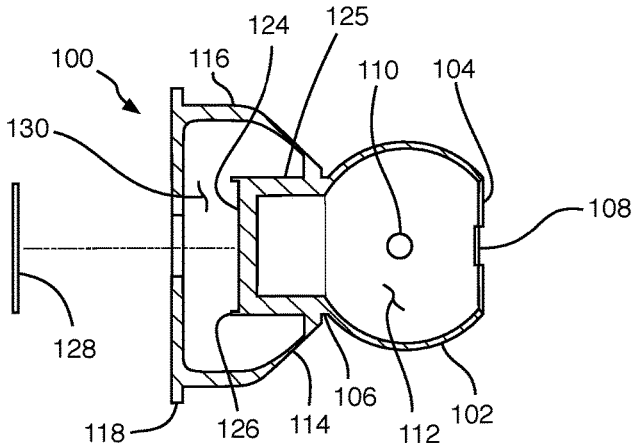
FIG. 7 is a cut view of the collapsible detector device taken along the lines 7-7 as seen in FIG. 5.

As seen in FIG. 7, collapsible detector device 100 further comprises top edge 104, having exterior notch 108. Sidewall 102 defines first cavity 112. Exterior notch 108 functions to allow ambient air to enter and escape from first cavity 112. Collapsible sidewall 114 and non collapsible sidewall 116 define second cavity 130. Interior wall 125 extends internally from neck 106, inside second cavity 130. Interior wall 125 is cylindrical in shape and has interior reflector wall 124. Interior reflector wall 124 and interior reflector wall edge 126 define a cavity wherein is mounted reflector 128.

Figure 8:
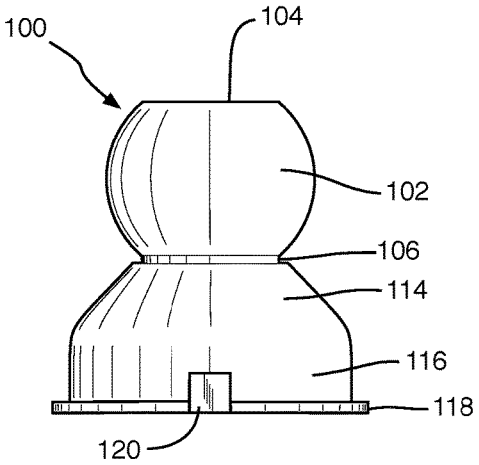
FIG. 8 is a top view of the collapsible detector device.
Figure 9:
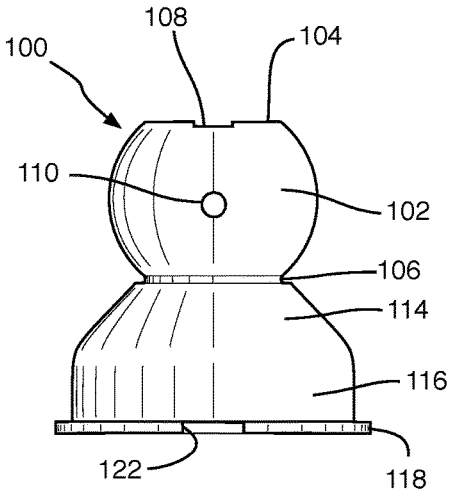
FIG. 9 is a bottom view of the collapsible detector device.

As seen in FIGS. 8 and 9, sidewall 102 extends between top edge 104 and neck 106. Extending from neck 106 is collapsible sidewall 114 defining a predetermined angle. Non-collapsible sidewall 116 extends from collapsible sidewall 114. Non-collapsible sidewall 116 has a first predetermined diameter, and base lip 118 has a second predetermined diameter, wherein the second predetermined diameter of base lip 118 is larger than the first predetermined diameter of non collapsible sidewall 116.

Figure 10:
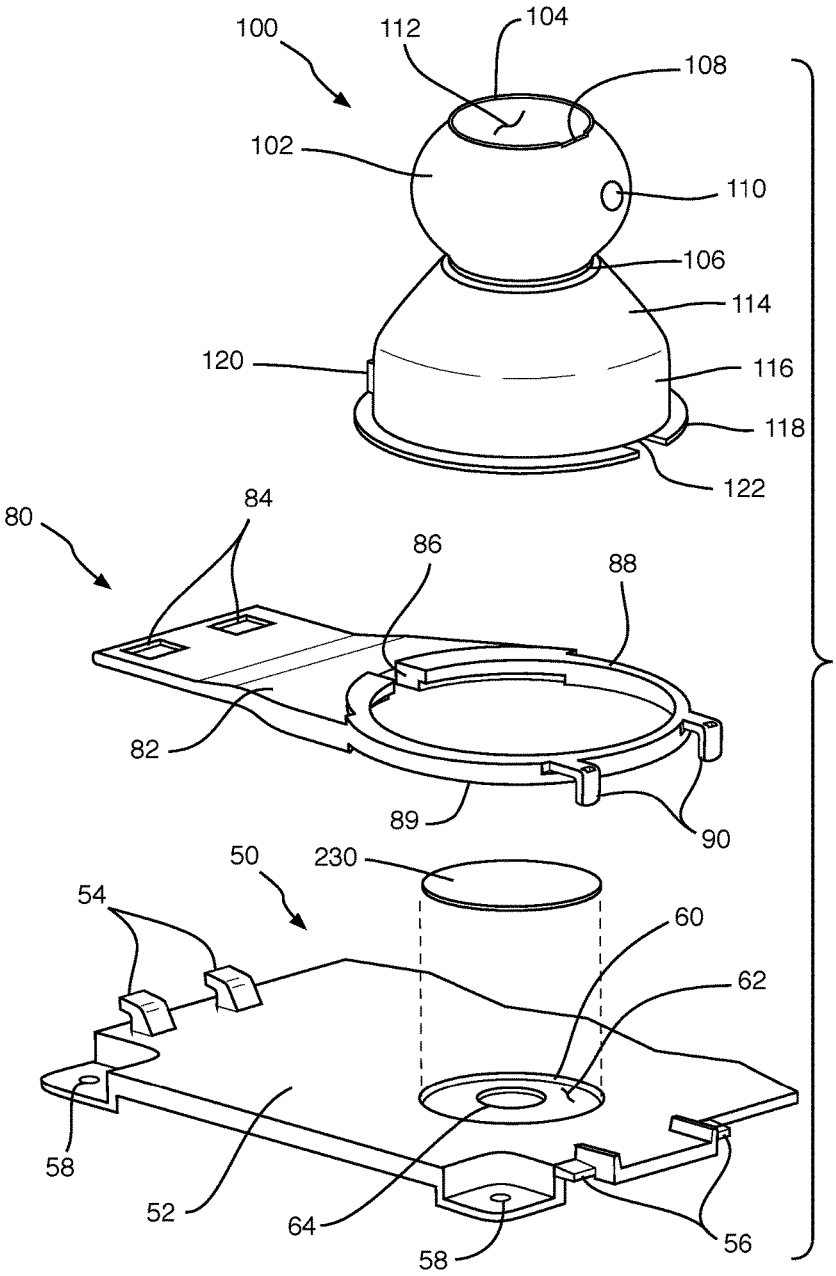
FIG. 10 is a partial exploded view of the self-contained container breach detector comprising a mounting plate, a retaining clip, and the collapsible detector device.

As seen in FIG. 10, mounting plate 50 comprises mounting wall 52 having mounting hooks 54, and tabs 56. Mounting wall 52 defines sensor cavity 62, which has sensor wall 60, and hole 64. Mounting plate 50 further has holes 58 to receive screws 66 to fix mounting plate 50 onto housing 30, as seen in FIG. 1. Mounting plate 50 further has at least one IR proximity and distance sensor 230 comprising electrical connections, not shown.

Retaining clip 80 comprises retaining plate 82, exterior face ring 88, and interior face ring 89. Exterior face ring 88 and interior face ring 89 comprise notch 86 that aligns to receive base protrusion 120. Retaining clip 80 further has plate holes 84 and retaining hooks 90.

Figure 11:
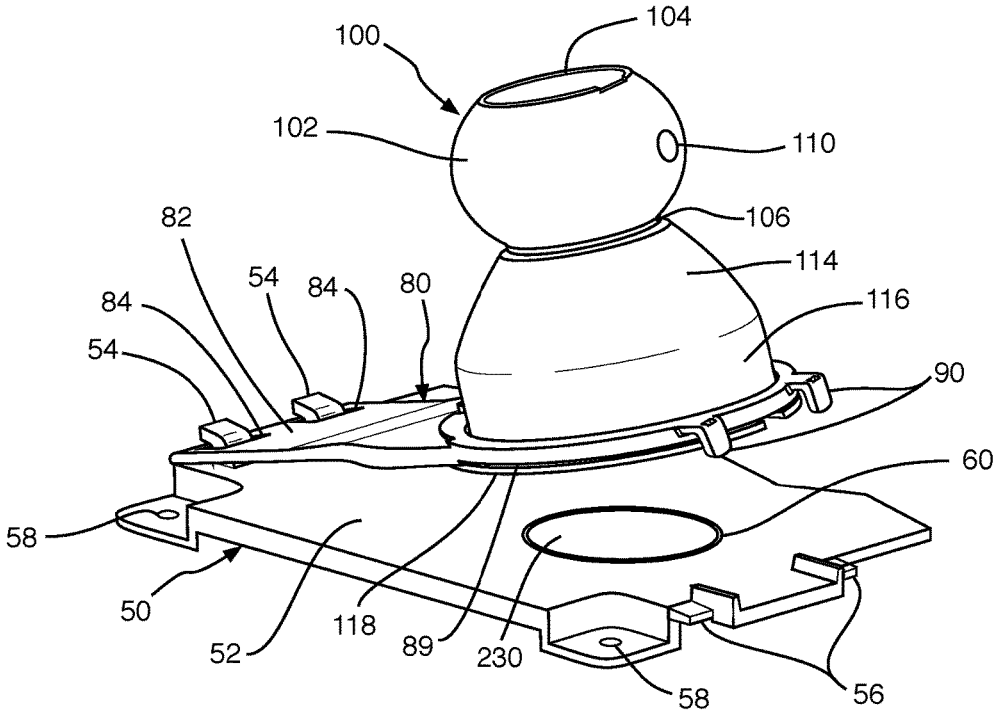
FIG. 11 is an isometric view of the retaining clip containing the collapsible detector device and being secured onto the mounting plate of the self-contained container breach detector.
Figure 12:
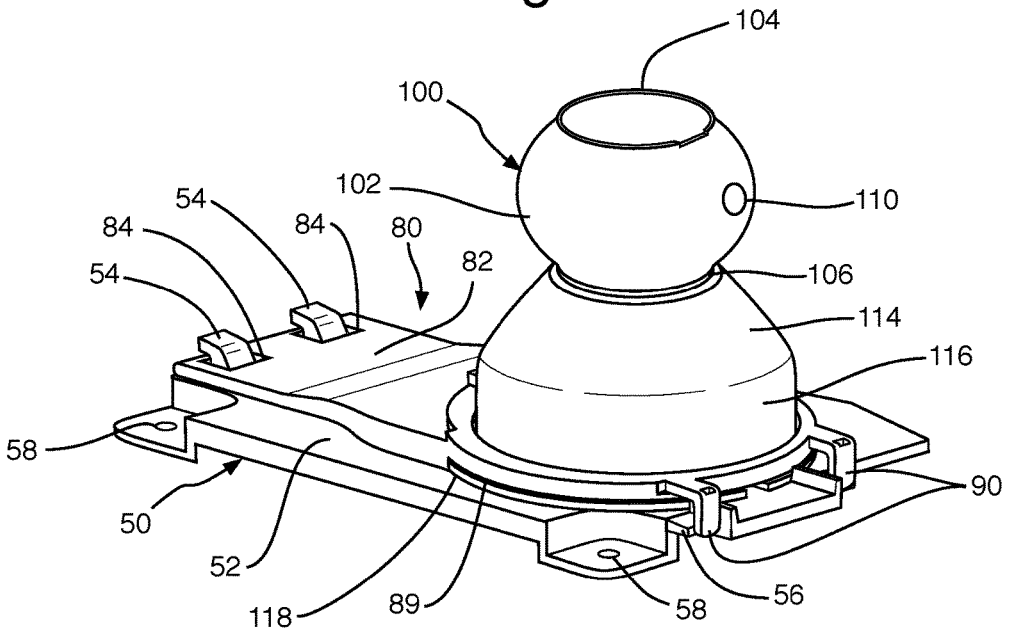
FIG. 12 is a first isometric view of the collapsible detector device secured onto the mounting plate of the self-contained container breach detector and in a neutral configuration.

As seen in FIGS. 11 and 12, when retaining clip 80 retains collapsible detector device 100 onto mounting plate 50, mounting hooks 54 secure retaining clip 80, whereby plate holes 84 receive mounting hooks 54. Base lip 118 is secured between interior face ring 89 and mounting wall 52. Interior face ring 89 has a third predetermined diameter, wherein the second predetermined diameter of base lip 118 and the third predetermined diameter of interior face ring 89 are approximately the same size. Retaining hooks 90 secure retaining plate 82 onto mounting wall 52. At least one IR proximity and distance sensor 230 is mounted onto sensor cavity 62.

Figure 13:
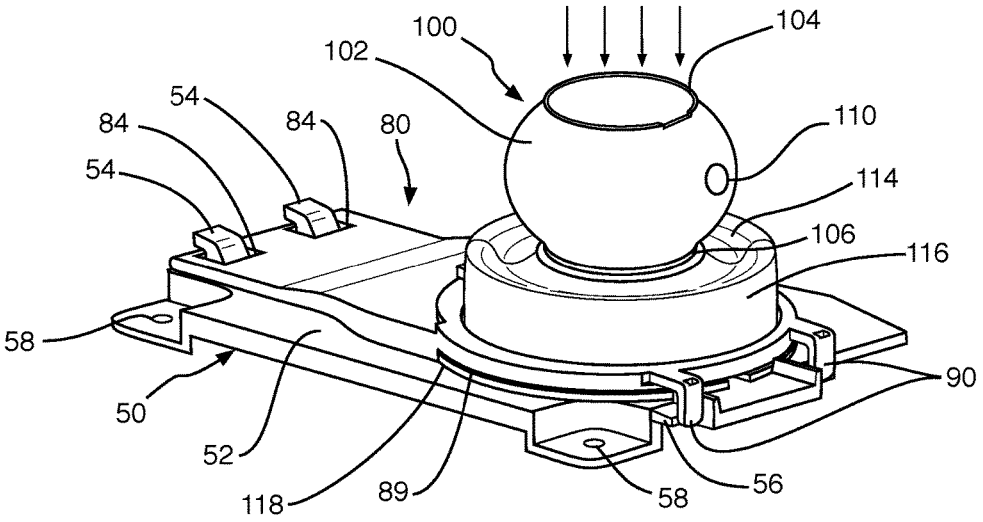
FIG. 13 is a second isometric view of the collapsible detector device secured onto the mounting plate of the self-contained container breach detector and in a collapsed configuration.
Figure 14:
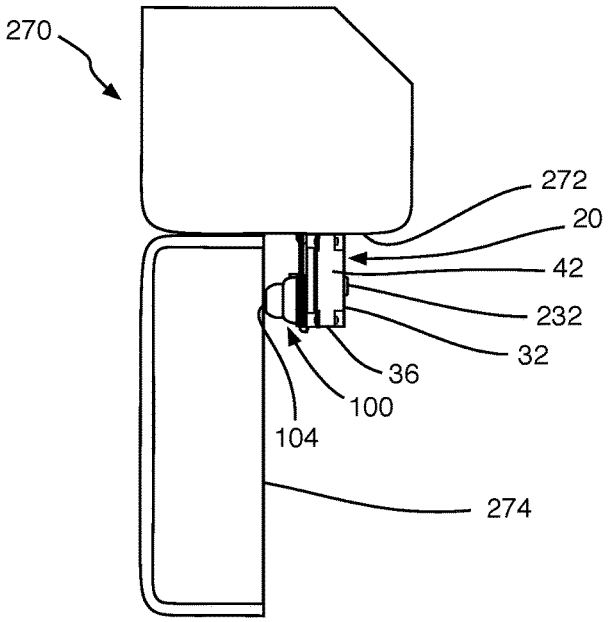
FIG. 14 is a side view of the self-contained container breach detector mounted internally within the transportation container with the collapsible detector devices in the collapsed configuration.

As seen in FIGS. 13 and 14, when a predetermined force is applied onto top edge 104, collapsible detector device 100 takes a collapsed configuration, whereby collapsible sidewall 114 collapses toward mounting wall 52. When the predetermined force applied onto top edge 104 is removed, collapsible detector device 100 returns to its neutral configuration, as seen in FIG. 12.

In operation, self-contained container breach detector 20 is mounted onto door frame 272, whereby collapsible detector device 100 faces door internal face 274. When the door of transportation container 270 is closed, door internal face 274 provides the predetermined force over collapsible detector device 100, and collapsible detector device 100 takes the collapsed configuration.

As collapsible detector device 100 is collapsing into the collapsed configuration, reflector 128, seen in FIG. 5, is biased towards IR proximity and distance sensor 230, seen in FIG. 11.

When the door of transportation container 270 opens, the predetermined force is removed, allowing collapsible detector device 100 to return to its neutral configuration. Therefore, reflector 128, seen in FIG. 5, separates from IR proximity and distance sensor 230, seen in FIG. 11, detecting a distance change from reflector 128, and is activated.

Figure 15:
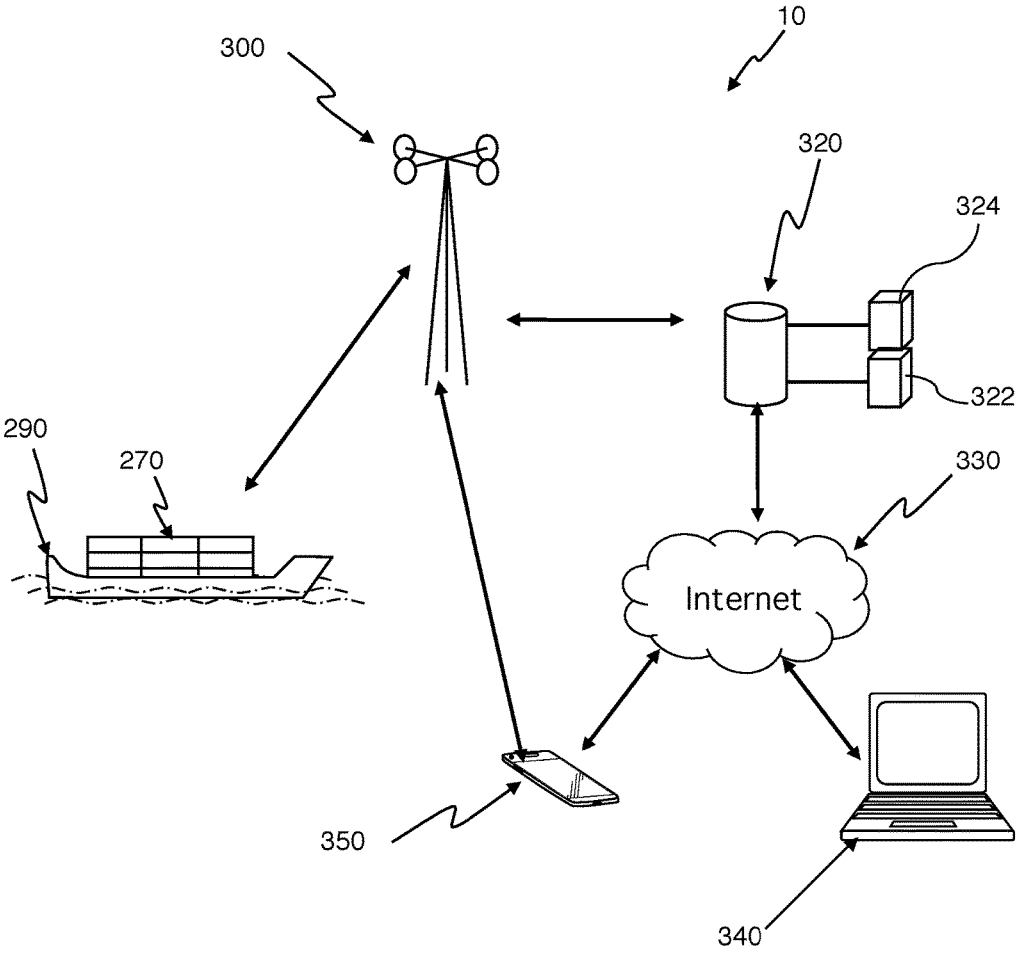
FIG. 15 is a system block diagram of the present invention.

As seen in FIG. 15, a system block diagram of present invention 10 is represented. In operation, once transportation container 270 is loaded with desired contents and matter:

A) self-contained container breach detector 20, seen in FIG. 1, is mounted onto transportation container 270, traveling on ship 290. It is noted that self-contained container breach detector 20 is self-contained and that its installation is simple, not requiring tools;

B) to activate self-contained container breach detector 20, cover labels not seen, are removed from sensors therefore causing sensors, wireless technology standards, and SIM card circuitry 210, seen in FIG. 4, to record and send an activation event date and time stamp data that includes a unique identification number of a respective communication tower 300. The activation event date and time stamp data may be sent via GSM radio module circuitry 190 seen in FIG. 4, to communication towers 300, and then to an operations center 320 having at least one server(s) 322 and/or computer(s) 324.

It is noted that communication towers 300 may also be defined as terrestrial towers, and/or a cell site. It is noted that each of communication towers 300 has its own unique identification number. A cell site is a site where antennas and electronic communications equipment are placed, usually on a radio mast, tower or other high place, to create a cell (or adjacent cells) in a cellular network. The elevated structure typically supports antennas, and one or more sets of transmitter/receivers transceivers, digital signal processors, control electronics, a GPS receiver for timing, primary and backup electrical power sources, and sheltering. A cell site is sometimes called a cell tower, even if the cell site antennas are mounted on a building rather than a tower. In GSM networks, the technically correct term is Base Transceiver Station (BTS), and synonyms are mobile phone mast or base station. The term base station site might better reflect the increasing co-location of multiple mobile operators, and therefore multiple base stations, at a single site. Depending on an operator's technology, even a site hosting just a single mobile operator may house multiple base stations, each to serve a different air interface technology (CDMA2000 or GSM, for example).

The operations center 320 having at least one server(s) 322 and/or computer(s) 324 may also send the activation event date and time stamp data via Internet 330 to designated computers 340 and/or cell phones 350. The activation event date and time stamp data, including the unique identification number of communication towers 300, may be sent by the various communication means of present invention 10 including text via short message service, SMS, and/or e-mail;

C) the doors of transportation container 270 are closed and locked;

D) while transportation container 270, having self-contained container breach detector 20 therein, is in communication towers' 300 working range, and either at least one IR proximity and distance sensor 230, at least one ambient light sensor 232, humidity sensor 234, and/or temperature sensor 236, seen in FIGS. 2 and 3, are activated, self-contained container breach detector 20 records and sends a breach event date and time stamp data that includes the unique identification number of a respective communication tower 300. As with the activation event date and time stamp data, the breach event date and time stamp data may be sent via GSM radio module circuitry 190 seen in FIG. 4, to communication towers 300, and then to operations center 320 having at least one server(s) 322 and/or computer(s) 324. The operations center 320 having at least one server(s) 322 and/or computer(s) 324 may also send the breach event date and time stamp data via Internet 330 to designated computers 340 and/or cell phones 350. The breach event date and time stamp data, including the unique identification number of a communication tower 300, may also be sent by the various communication means of present invention 10 including text via short message service, SMS, and/or e-mail;

E) self-contained container breach detector 20 may also be programmed to send status event date and time stamp data at predetermined time periods. As an example, predetermined time periods may be 24, or 36, or 48 hours, or days, or weeks. The status event date and time stamp data may include information as to whether at least one IR proximity and distance sensor 230, at least one ambient light sensor 232, humidity sensor 234 and/or temperature sensor 236 seen in FIGS. 2 and 3, are activated. As with the activation and breach event date and time stamp data, the status event date and time stamp data may be sent via GSM radio module circuitry 190 seen in FIG. 4, to communication towers 300 and then to the operations center 320 having at least one server(s) 322 and/or computer(s) 324. The operations center 320 having at least one server(s) 322 and/or computer(s) 324 may also send the status event date and time stamp data via Internet 330 to designated computers 340 and/or cell phones 350. The status event date and time stamp data, including the unique identification number of a communication tower 300, may also be sent by the various communication means of present invention 10 including text via short message service, SMS, and/or e-mail;

F) if transportation container 270, having self-contained container breach detector 20 therein, is not within communication towers' 300 working range, and a predetermined time period is reached and/or either at least one IR proximity and distance sensor 230, at least one ambient light sensor 232, humidity sensor 234 and/or temperature sensor 236 seen in FIGS. 2 and 3, are activated, self-contained container breach detector 20 records and attempts to send the status and/or breach event date and time stamp data that includes the unique identification number of a respective communication tower 300; and G) when transportation container 270, having self-contained container breach detector 20 therein, is again within in a communication towers 300 working range, sensors, wireless communications, and SIM card circuitry 210 seen in FIG. 4, sends all recorded status and/or breach event date and time stamp data, if any, and the unique identification number of a respective communication tower 300, via GSM radio module circuitry 190 seen in FIG. 4, to communication towers 300 and then to the operations center 320 having at least one server(s) 322 and/or computer(s) 324. The operations center 320 having at least one server(s) 322 and/or computer(s) 324 may also send the each status and breach event date and time stamp data, if any, via Internet 330 to designated computers 340 and/or cell phones 350. Each status and/or breach event date and time stamp data may be sent by the various communication means of present invention 10 including text via short message service, SMS, and/or e-mail.

It is noted that from communication towers 300, the activation, breach, and status event date and time stamp data may also be sent directly to cell phones 350. Self-contained container breach detector 20 comprises an industrial, scientific and medical band radio circuitry comprising remote control means to function as a remote control to request activation, status, and/or breach event date and time stamp data and a unique identification number of the public cellular receiver tower being a communication tower, to identify when and where authorized and/or unauthorized breaches of the transportation container occurred, the remote control means comprises an ISM power switch and an ISM radio.

Present invention 10 therefore is a container breach detector system to monitor breaches of transportation container 270. Self-contained container breach detector 20 provides activation, status, and/or breach event date and time stamp data for a user to determine when and where authorized and/or unauthorized breaches of transportation container 270 occurred. Furthermore, self-contained container breach detector 20 serves as a recording device to record the activation, status, and/or breach event date and time stamp data; and communicates via various communication means including text via short message service, SMS, and/or e-mail. Self-contained container breach detector 20 is intended for a one-time use only, to be discarded at destination. Each self-contained container breach detector 20 has individual serial numbers, as bolt seals for transportation containers 270 currently have. Encapsulating composition 172, seen in FIG. 2, ensures that self-contained container breach detector 20 is used only once, and is not removed, recharged and reused.

Figure 16:
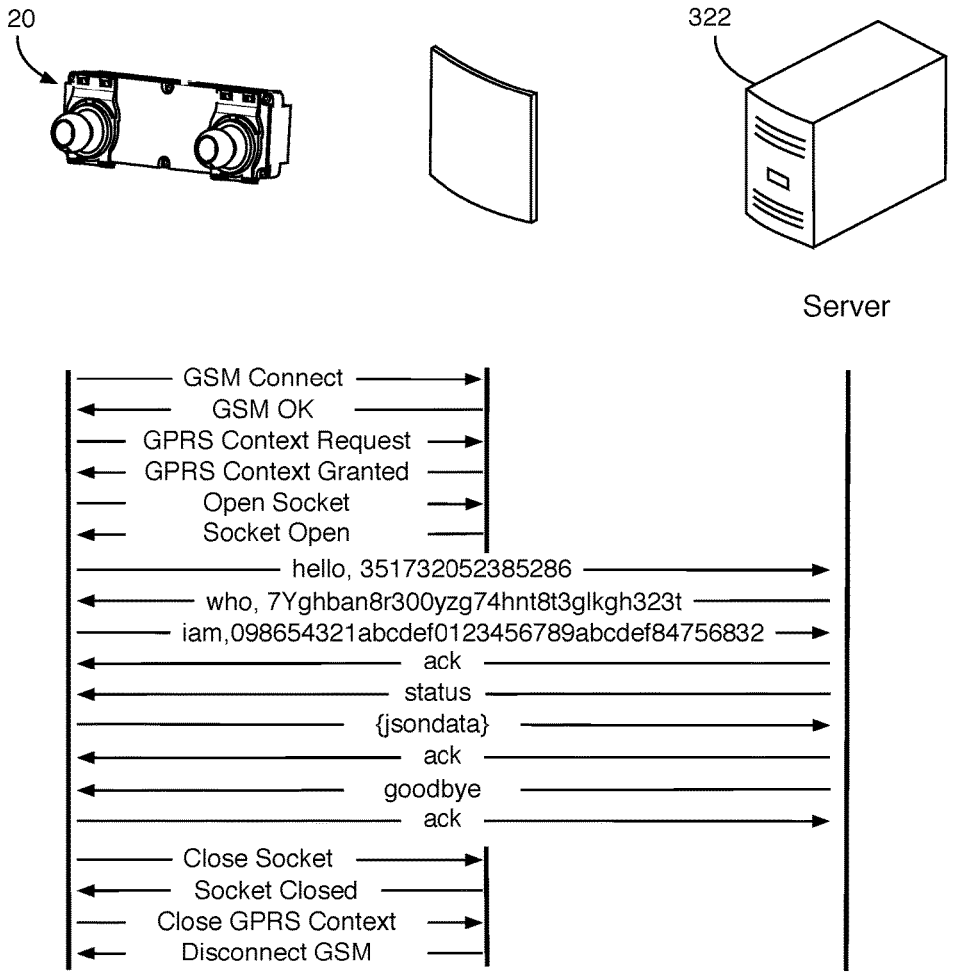
FIG. 16 is a server communication flow system diagram of the present invention.

As seen in FIG. 16, a communication protocol is constructed to be efficiently implemented in a hardware platform of self-contained container breach detector 20, which has limited memory and processing speed. GSM/GPRS communication can be subject to limited bandwidth and service interruptions or timeout. The communication protocol must be robust enough to ensure end-to-end transfer of information is confirmed. Battery life is a provision that must also be considered in the design of the communication protocol, ensuring that reasonable timeouts are provided, and that excess information is limited. The communication protocol must have provisions to allow additions of data as self-contained container breach detector 20 platform evolves.

In a preferred embodiment, self-contained container breach detector 20 initiates communication between self-contained container breach detector 20 and server(s) 322. In a preferred embodiment, server(s) 322 must be able to accept at least 100 connections simultaneously at any time to support phase two deployment of 3000 units in the field. Server(s) 322 will need to support in excess of 8000 connections to support phase three deployment of 1,000,000 units and more. During a connection, server(s) 322 may send commands to self-contained container breach detector 20 as detailed below to alter operation or request additional information.

Initially a GSM/GPRS connection is established with a GSM carrier, wireless carrier. Once this connection is open, self-contained container breach detector 20 will open a socket to server(s) 322 and send a "Hello" message indicating that it wishes to communicate. Server(s) 322 replies with a request for self-contained container breach detector 20 to identify itself. Once self-contained container breach detector 20 has been authenticated, server(s) 322 will issue commands, beginning with a status request until server(s) 322 is satisfied with the data received and has issued any additional commands required and received the responses. When server(s) 322 is satisfied with a communication session it sends a "Goodbye" message to self-contained container breach detector 20, which will tear down the socket and disconnect from the GSM tower.

Figure 17:
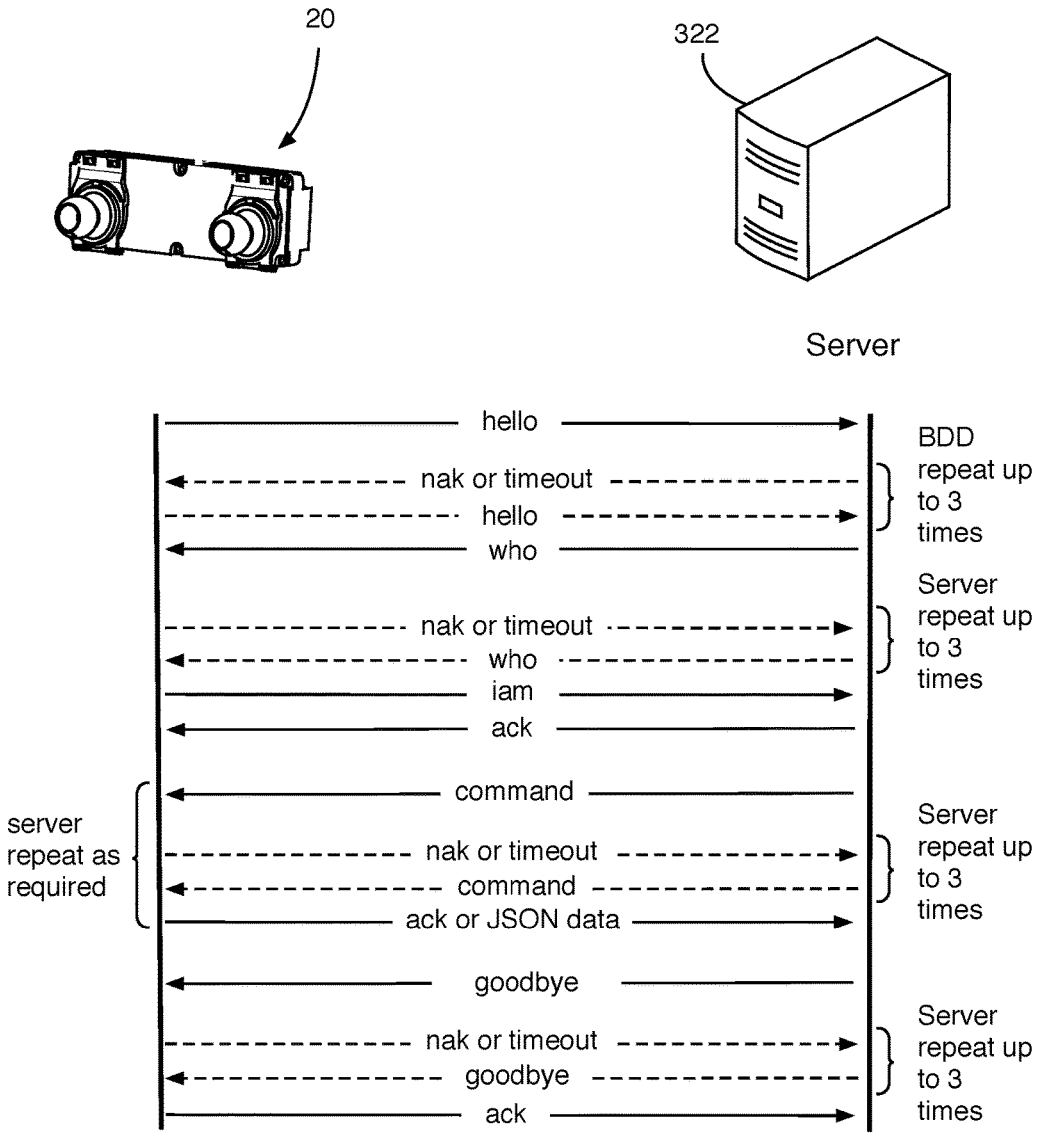
FIG. 17 is a server protocol with error handling system diagram of the present invention.

As seen in FIG. 17, in a preferred embodiment, self-contained container breach detector 20 will initiate communications by opening a TCP connection to a predefined TCP/IP port on server(s) 322. A port number is chosen at random from a range of port numbers allocated by Internet Assigned Numbers Authority (IANA) for private, dynamic and ephemeral ports. In self-contained container breach detector 20 and server 322 Protocol with Error Handling, self-contained container breach detector 20 is responsible for establishing a connection between self-contained container breach detector 20 and server(s) 322. Once a socket is opened and the initial "Hello" message is sent to server(s) 322 by self-contained container breach detector 20, server(s) 322 will control the remainder of the communication session.

If self-contained container breach detector 20 detects excessive errors or exceeds a timeout value, it may disconnect the socket and turn off radio power without direct notification to server(s) 322. Server(s) 322 will detect this condition as a socket disconnect.

The purpose of present invention 10 is to identify the time of an unauthorized entry into the shipping container being protected. This protects the owner of the cargo by making it possible to identify the entity or individual with fiduciary responsibility for the cargo at the time the breach occurs.

The system operates by connecting to server(s) 322 on a regular basis and providing updates of the current status of self-contained container breach detector 20 protecting transportation container 270, also defined as a shipping container. If transportation container 270 is breached, entered, or otherwise opened, self-contained container breach detector 20 immediately attempts to contact server(s) 322 with information about the time of the breach.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container breach detector system, comprising a self-contained container breach detector comprising a housing, said housing comprising a mounting plate having a mounting wall, said mounting wall defines at least one sensor cavity, secured onto said mounting wall is at least one retaining clip that retains a collapsible detector device, said collapsible detector device comprising a sidewall, a collapsible sidewall and a reflector, said sidewall comprising a drain hole, said collapsible sidewall extends to a non-collapsible sidewall having a first diameter, said non-collapsible sidewall comprises a base lip having a second diameter, a base protrusion extends from said base lip and said non-collapsible sidewall towards said collapsible sidewall without reaching said collapsible sidewall, said reflector is mounted internally onto an interior reflector wall within said collapsible detector device, said reflector is at a first predetermined distance from said mounting wall when said collapsible detector device is in a neutral configuration, and is at a second predetermined distance from said mounting wall when said collapsible detector device is in a collapsed configuration, said self-contained container breach detector is mounted onto a door frame of a transportation container, said transportation container has at least one door with a respective door internal face, said self-contained container breach detector is positioned whereby said mounting plate faces said door internal face and is entirely mounted within said transportation container to monitor breaches of said transportation container, whereby said collapsible detector device is in said collapsed configuration when said door is closed and said collapsible detector device is in said neutral configuration when said door is opened, said self-contained container breach detector further comprising an electrical system, said electrical system comprises:

5975a main printed circuit board;

B) a global system for mobile communications radio module circuitry comprising cellular network communication means with capabilities to communicate directly to and from a public cellular receiver tower positioned at a working range from said self-contained container breach detector;

C) power circuitry comprising power means;

D) at least one set of sensors comprising at least one IR proximity and distance sensor, wireless technology standard, and subscriber identity module card circuitry, said at least one IR proximity and distance sensor detects a proximity or distance change of said door internal face when said collapsible detector device changes from said collapsed configuration to said neutral configuration indicating that said door is open; and E) a central processing unit.

2. The container breach detector system set forth in claim 1, further characterized in that said at least one IR proximity and distance sensor is mounted onto said at least one sensor cavity.

3. The container breach detector system set forth in claim 1, further characterized in that said at least one IR proximity and distance sensor is aligned with said reflector.

4. The container breach detector system set forth in claim 1, further characterized in that said mounting plate comprises at least one mounting hook to secure said at least one retaining clip.

5. The container breach detector system set forth in claim 4, further characterized in that said at least one retaining clip comprises at least one plate hole that receives said at least one mounting hook to secure said at least one retaining clip.

6. The container breach detector system set forth in claim 1, further characterized in that said at least one retaining clip comprises a retaining plate, an exterior face ring, and an interior face ring.

7. The container breach detector system set forth in claim 6, further characterized in that said exterior face ring and said interior face ring comprise a notch.

8. The container breach detector system set forth in claim 6, further characterized in that said at least one retaining clip comprises retaining hooks to secure said retaining plate.

9. The container breach detector system set forth in claim 6, further characterized in that said sidewall extends between a top edge and a neck, said top edge comprises an exterior notch, extending from said neck is said collapsible sidewall.

10. The container breach detector system set forth in claim 6, further characterized in that said base lip is positioned between said interior face ring and said mounting wall when said at least one retaining clip retains said collapsible detector device.

11. The container breach detector system set forth in claim 6, further characterized in that said interior face ring has a third diameter.

12. The container breach detector system set forth in claim 11, further characterized in that said second diameter and said third diameter are approximately the same size.

13. The container breach detector system set forth in claim 1, further characterized in that said second diameter is larger than said first diameter.

14. The container breach detector system set forth in claim 1, further characterized in that said at least one set of sensors comprises at least one ambient light sensor.

15. The container breach detector system set forth in claim 1, further characterized in that said at least one set of sensors comprises at least one humidity sensor.

16. The container breach detector system set forth in claim 1, further characterized in that said at least one set of sensors comprises at least one temperature sensor.

17. The container breach detector system set forth in claim 1, further characterized in that said housing comprises a wall defined between a top wall and a bottom wall, first and second lateral walls and a perimeter edge.

18. The container breach detector system set forth in claim 17, further characterized in that opposite said wall is said mounting plate, and said electrical system is embedded within said housing.

19. The container breach detector system set forth in claim 1, further characterized in that said at least one set of sensors, wireless technology standard, and subscriber identity module card circuitry are mounted onto said main printed circuit board.

20. The container breach detector system set forth in claim 1, further characterized in that said self-contained container breach detector further comprises an encapsulating composition, said encapsulating composition ensures that said self-contained container breach detector is used only once, whereby removal of said encapsulating composition damages said electrical system, said encapsulating composition is an optically clear epoxy chemical composition filling within said housing to cover said electrical system.

21. The container breach detector system set forth in claim 1, further characterized in that said self-contained container breach is secured with at least one double-sided tape.

22. The container breach detector system set forth in claim 14, further characterized in that said self-contained container breach detector provides activation, status, and/or breach event date and time stamp data and a unique identification number of said public cellular receiver tower being a communication tower, to identify when and where authorized and/or unauthorized breaches of said transportation container occurred when said at least one IR proximity and distance sensor and/or said at least one ambient light sensor is activated.

23. The container breach detector system set forth in claim 1, further characterized in that said self-contained container breach detector serves as a recording device to record activation, status, and/or breach event date and time stamp data and a unique identification number of said public cellular receiver tower being a communication tower.

24. The container breach detector system set forth in claim 23, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to respective said communication tower.

25. The container breach detector system set forth in claim 23, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, to an operations center having at least one server(s) and/or computer(s).

26. The container breach detector system set forth in claim 23, further characterized in that recorded said activation, status, and/or breach event date and time stamp data and said unique identification number of said communication tower, is communicated via said cellular network communication means including text via short message service, SMS, and/or internet protocol communications including TCP/IP, UDP/IP, and e-mail, via Internet to designated computers and/or cell phones.

27. The container breach detector system set forth in claim 23, further characterized in that recorded said activation, status, and/or breach event date and time stamp data and said unique identification number of said communication tower, is communicated via said cellular network communication means to cell phones.

28. The container breach detector system set forth in claim 1, comprises an industrial, scientific and medical band radio circuitry comprising remote control means to function as a remote control to request activation, status, and/or breach event date and time stamp data and a unique identification number of said public cellular receiver tower being a communication tower, to identify when and where authorized and/or unauthorized breaches of said transportation container occurred, said remote control means comprises an ISM power switch and an ISM radio.

* * * * *